US005501282A

United States Patent [19]

Sundholm

[11] Patent Number: 5,501,282

[45] Date of Patent: Mar. 26, 1996

[54] FIRE-FIGHTING EQUIPMENT

[76] Inventor: Göran Sundholm, Ilmari Kiannon kuja 3, FIN-04310 Tuusula, Finland

[21] Appl. No.: 175,392

[22] PCT Filed: Jul. 10, 1992

[86] PCT No.: PCT/FI92/00213

§ 371 Date: Jun. 1, 1994

§ 102(e) Date: Jun. 1, 1994

[87] PCT Pub. No.: WO93/00962

PCT Pub. Date: Jan. 21, 1993

[30] Foreign Application Priority Data

Jul. 12, 1991 [FI] Finland ..... 913394
Oct. 11, 1991 [FI] Finland ..... 914823

[51] Int. Cl.[6] ..... A62C 37/08

[52] U.S. Cl. ..... 169/37

[58] Field of Search ..... 169/37, 90, 38, 169/39, 40, 41, 5, 16, 54, 56

[56] References Cited

U.S. PATENT DOCUMENTS

| | | | |
|---|---|---|---|
| 1,826,072 | 10/1931 | Hamilton | 169/37 |
| 1,837,322 | 12/1931 | Hamilton | 169/37 |
| 2,235,258 | 3/1941 | Jones | 169/37 |
| 3,714,989 | 2/1973 | Gloeckler . | |
| 4,014,388 | 3/1977 | Anderson . | |
| 4,066,129 | 1/1978 | Anderson | 169/37 |
| 4,508,175 | 4/1985 | Pieczykolan . | |
| 4,527,635 | 7/1985 | Kirchner . | |
| 4,845,629 | 7/1989 | Murga . | |
| 4,880,063 | 11/1989 | Leininger et al. . | |
| 4,976,320 | 12/1990 | Rolan . | |

FOREIGN PATENT DOCUMENTS

| | | |
|---|---|---|
| 20505672 | 9/1992 | European Pat. Off. . |
| 854407 | 11/1979 | U.S.S.R. . |
| 895459 | 5/1980 | U.S.S.R. . |

OTHER PUBLICATIONS

Kudrov, G. A., Derwent's abstract No. G52 83 E/22, publ. week 8222.

Gazarkh, V. G., Derwent's abstract No. Q11 02 E/46, publ. week 8246.

*Primary Examiner*—Stephen Avila
*Attorney, Agent, or Firm*—Ladas & Parry

[57] ABSTRACT

The object of the invention is to provide a new fire-fighting equipment which in a simple manner eliminates the risk for premature blocking and which enables numerous applications. In a preferred embodiment of the invention a spray head (5) intended for a high driving pressure is mounted in a holder (3) fastened in a floor (1), with a shield (8) above the spray head, on floor level, when the equipment is in a state of rest. Upon activation of the equipment the spray head rises up under the influence of the extinguishing liquid and removes the shield (8).

12 Claims, 4 Drawing Sheets

FIRE-FIGHTING EQUIPMENT

The present invention relates to a fire-fighting equipment with a number of means for spraying extinguishing liquid, at least a part of said means being, in inactive state, covered by a shield.

In the patent publications U.S. Pat. Nos. 3,714,989, 4,066,129, 4,508,175, 4,880,063 and 4,976,320 are described conventionl low pressure sprinklers, which mainly for esthetical reasons are provided with a cover on ceiling level. The respective cover is kept in place by means of a soldered joint, which shall melt while the temperature, after a fire has started, rises to the activating temperature of the sprinkler.

The object of the invention is to provide a new fire-fighting equipment which is of a simple structure and enables a plurality of advantageous applications.

The fire-fighting equipment according to the invention is mainly characterized in that the means for spraying extinguishing liquid are spray heads capable of operating with a high drive pressure, preferably producing concentrated fog sprays with strong penetration power, and that the respective shield is arranged, upon activation of the respective spray head, to be removed by the action of the extinguishing liquid.

By a high drive pressure, i.e. operating pressure, is in this context meant a pressure which is considerably higher than ordinary water pipe pressure of 6–7 bar. A limit value is difficult to present, but preferably an operating pressure of at least 100 bar, often up to near 300 bar, is employed. Upon activating the spray head, the extinguishing liquid can be made to exert, directly or indirectly, a very great force upon the shield in front of the spray head, so that the shield is removed in spite of firm mounting, e.g. by means of a form fitting and/or a press fitting, or a great holding load from the outside. By employing a liquid under high pressure for removing the shield of the spray head is achieved, in addition, that the shield is not shot off like a projectile in spite of a great removing force.

In a preferred embodiment of the invention at least one of said spray heads provided with a shield is movably mounted in such a way in a holder fastened in a floor that the spray head, upon activation, is lifted up by the liquid pressure and removes the shield arranged in front of the spray head, whereat the spray head preferably is arranged to be lifted up to such an extent that the nozzles of the spray head rise a little higher than the surface of the floor.

Concentrated fog sprays with a strong power of penetration can be achieved by constructing the nozzles of the spray head and by arranging them mutually in accordance to what is presented in the Finnish patent applications 913059, 914704 and 915078 in such a way that the fog sprays of the individual nozzles grip into each other and produce a concentrating suction. Necessary access to suction air is secured by the spray head rising a little above the floor, so that air can flow in from the space between the nozzles and the floor.

As will appear further on in the description, the spray head and its holder in the floor can be brought to interact like a hydraulic cylinder, whereat is obtained such a great lifting force on the covering shield or cover that it is lifted up even if a wheel of a loaded truck stood on the cover, which may be the case on a vehicle deck in a ship.

Location in a floor is a good solution for purely technical fire-fighting reasons as well, partly because fire often breaks out on floor level and partly because a water fog sprayed upwards is well spread and is airborne for a relatively long time before falling down on the floor, which brings about a good cooling effect.

If an automatic fire-fighting system is to be installed later in already completed buildings or ships, ceiling installation work is connected with great difficulties, among other things because ceiling structures often are light, with a limited capability of enduring mechanical loads.

Floor structures are steady, which facilitates the installation work. General accessability is, further, considerably better than in ceiling structures.

In computer rooms and the like there are often cable channels and ventilation channels under the floor, in which channels a fire may cause great damage. In a preferred embodiment of the invention at least one spray head is arranged to spray liquid into one or a plurality of such channels. This application can be developed to spray extinguishing liquid into an underlying room.

Some kinds of fire, e.g. oil fires, develop such a smoke that the outlet aperture of a nozzle can be blocked by soot before activation of the equipment, so that the nozzle will be out of function.

In addition, there are objects liable to catch fire, such as friteuses for pommes frites, from which during normal operation rise fat and other vapours, which may block a nozzle placed above.

For such objects it is suggested to provide a cover in the individual nozzle apertures of the respective spray head.

A plate-like cover of metal or plastics in front of the outlet aperture of the spray head can be rather steadily fastened by means of a form fitting and/or a press fitting; if the diameter of the cover is e.g. 10 mm and the operating pressure of the sprinkler is about 100 bar, one obtains a force of about 80 kp, which presses out the cover without shooting it off like a projectile, however.

In the following the invention shall be described with reference to exemplifying embodiments shown in the attached drawing.

Figure 1:
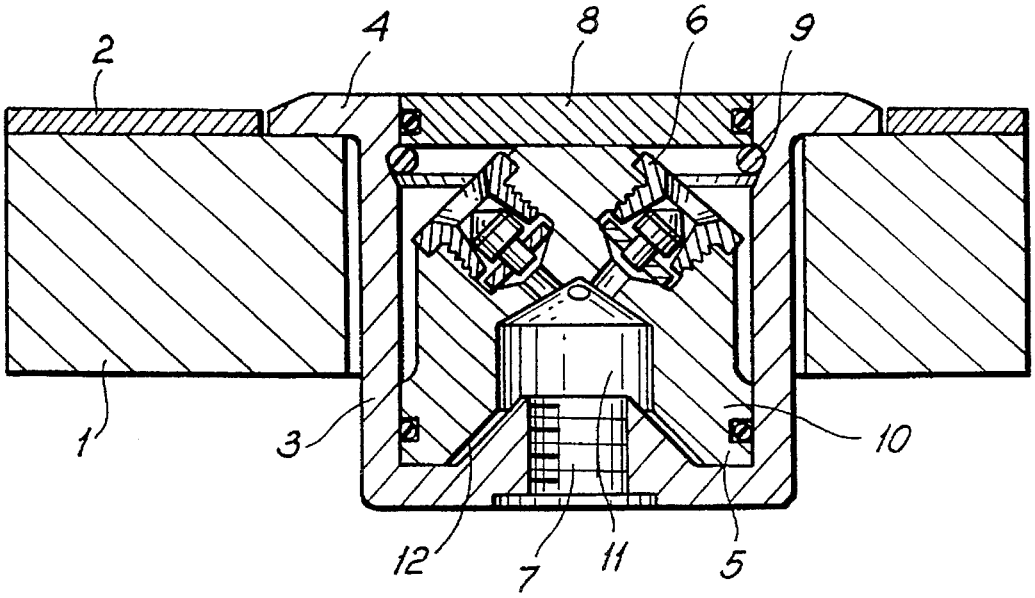
FIG. 1 shows a first embodiment, when the equipment is in state of rest.
Figure 2:
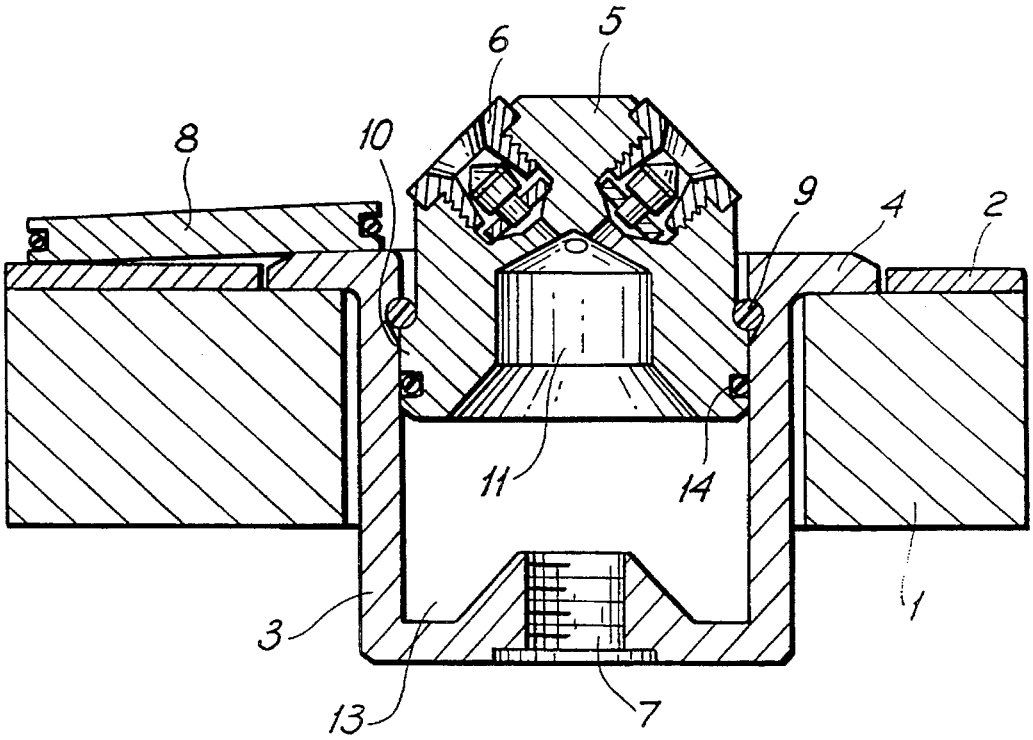
FIG. 2 shows the embodiment of FIG. 1, in activated state.

In FIGS. 1 and 2, the reference numeral 1 designates a floor with a wear surface 2. 3 designates a holder firmly fastened in the floor, with a fastening flange 4 in level with the surface 2 of the floor.

In the holder 3 is slidably mounted a spray head 5 with a number of nozzles 6, which can be activated to spray water sprays, preferably in the form of a water fog with small drops and under a high pressure. A nozzle structure suitable for the purpose is described in the Finnish patent application 913059.

The nozzles 6 are preferably arranged in such a way with respect to each other that their fog sprays so to speak grip into each other and produce a concentrated fog spray having a strong penetration power, as is described in the Finnish patent applications 914704 and 915078.

The reference numeral 7 designates an inlet connection for a water pipe, 8 designates a shield or a cover in level with the fastening flange 4. A stopper ring supported from above in the wall of the holder 3 is indicated by 9. This ring restricts the movement of the housing 5 upwards by interaction with to a shoulder 10 in the spray head.

The reference numeral 11 designates a liquid distributing space in the spray head, from which space 11 extinguishing liquid passes out to the different nozzles 6 upon activation of the spray head. A gap between the lower part of the spray head 5 and the holder 3 is indicated by 12.

In FIG. 1 the spray head is in a state of rest pressed into the holder 3 against the bottom thereof and with the cover 8 in place above the spray head.

Upon activation of the spray head, after a fire has been established, extinguishing liquid under a high pressure is flowing from the inlet 7 to the distribution space 11; the liquid pressure acts through the gap 12 and the whole inner cross section of the holder 3 and drives the spray head 5 upwards with a great force, like a hydraulic cylinder where the inner space 13 of the holder constitutes the cylinder chamber and the spray head 5 the piston, whereat the cover 8 is lifted away by the spray head 5, which is laid free for spraying extinguishing liquid upwards. Between the spray head 5 and the inner wall of the holder 3 is arranged a seal 14.

FIG. 2 shows the activated state of the spray head, the nozzles 6 preferably being so much above the floor surface 2 and the flange 4 that air necessary for producing concentrated strong fog sprays can be sucked in from the sides on the floor level, under the level of the nozzles 6.

Figure 3:
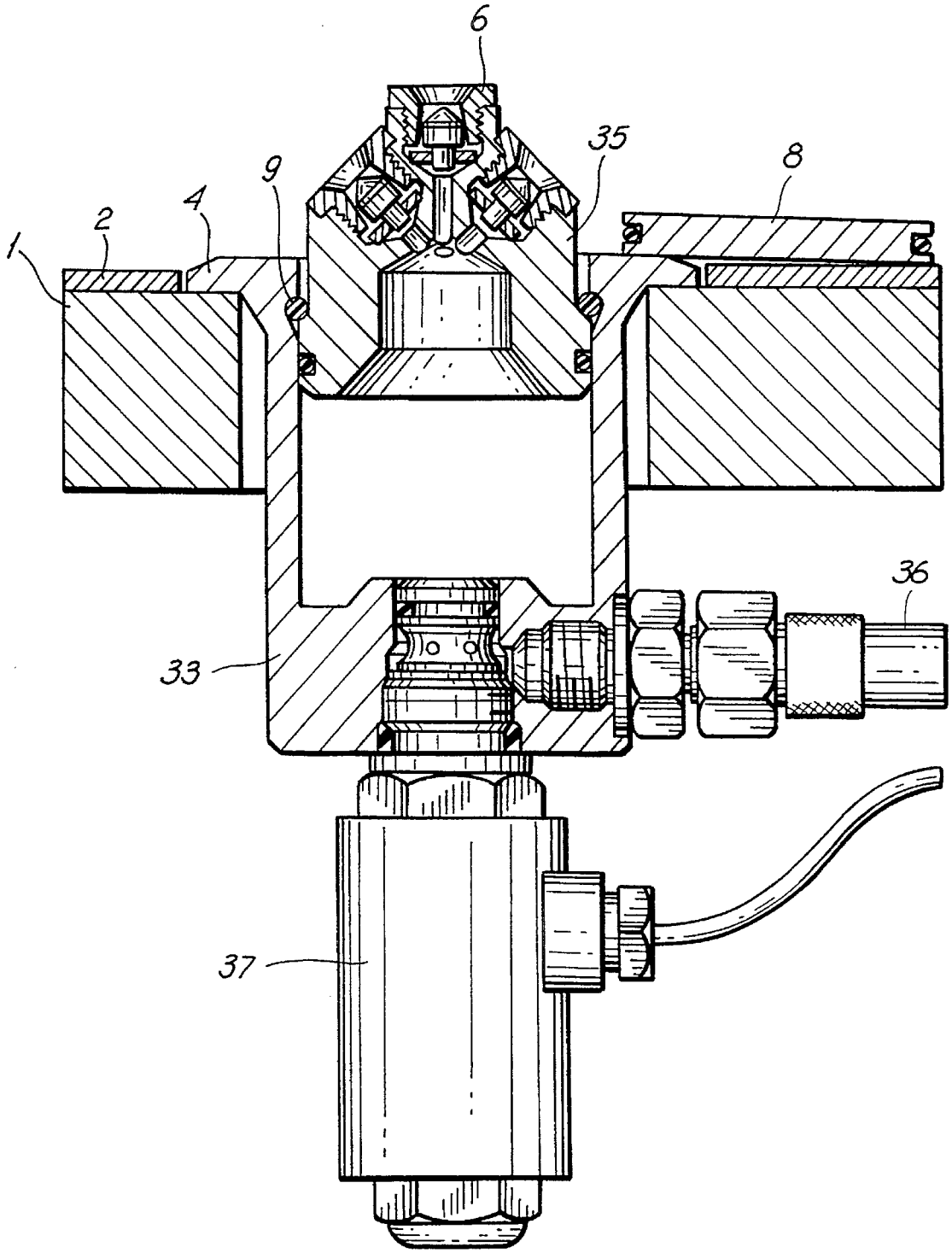
FIG. 3 shows a second embodiment, when the equipment is in activated state.

In FIG. 3 which shows an alternative embodiment in activated state, the reference numerals 1, 2, 4, 6, 8 and 9 indicate the same as in the FIGS. 1 and 2. The spray head 35 differs from the spray head 5 in the FIGS. 1 and 2 mainly by a top nozzle 6.

To the bottom part of the holder 33 are connected a water hose or pipe 36 and a preferably hydraulically or pneumatically operable control valve 37, which enables individual activation of the spray head 35 by switching on a pressurized extinguishing liquid through the pipe 36. In the embodiment of the FIGS. 1 and 2, as well as in the embodiment of FIG. 4, which is to be described in the following, activation is thought to take place in common for a plurality of spray heads in a suitable manner, the provision of which per se does not cause any difficulty for a person skilled in the art, for which reason hoses, operation means etc. have not been drawn in these figures.

In principle the embodiment of FIG. 3 operates all in accordance to the embodiment of the FIGS. 1 and 2.

Figure 4:
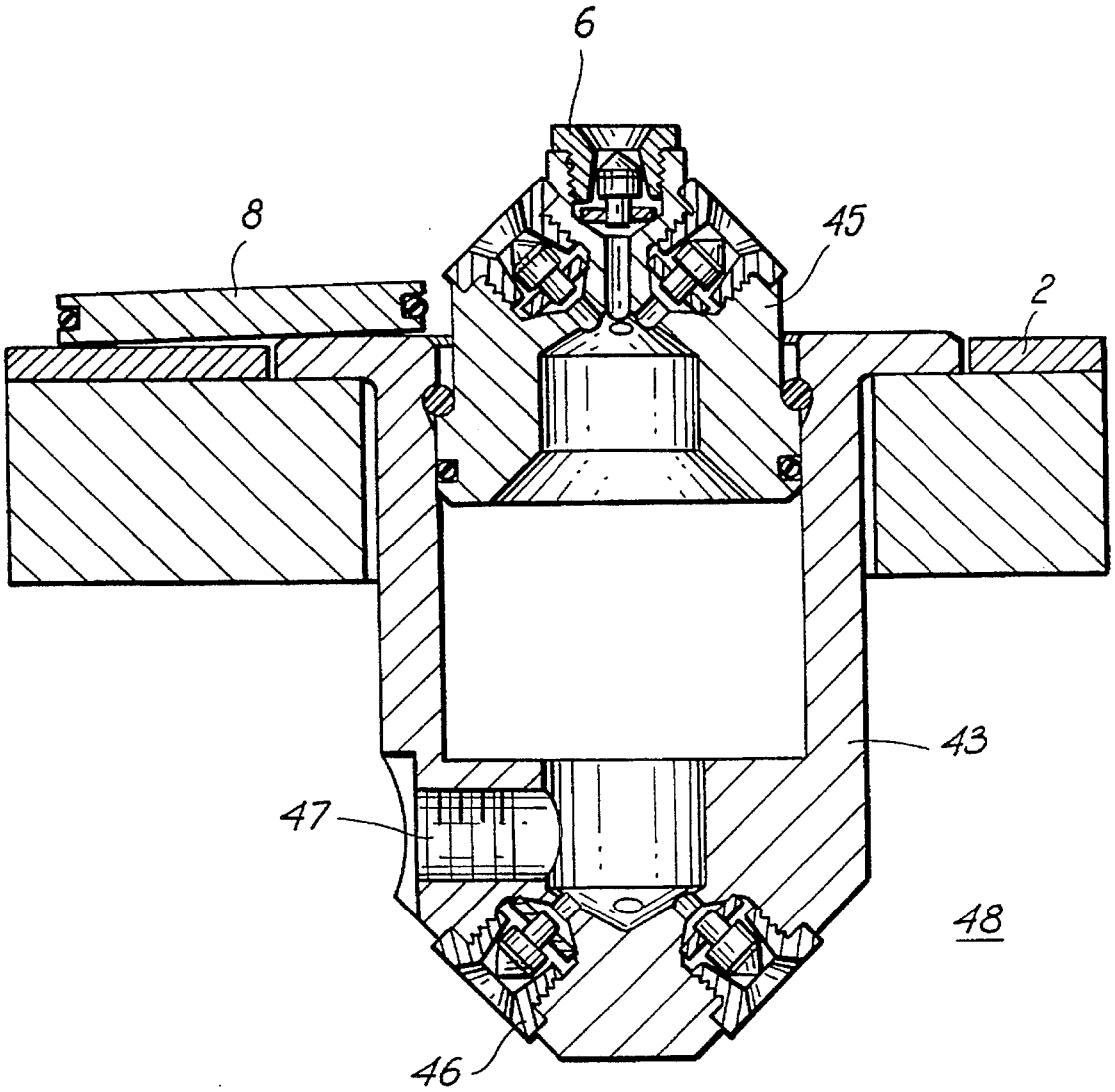
FIG. 4 shows a third embodiment, in activated state.

In FIG. 4 which shows still another alternative embodiment in activated state, the reference numerals 2, 6 and 8 designate a floor surface, the nozzles of the spray head and a cover, respectively, as earlier. The spray head 45 is similar to 35 in FIG. 3.

In the bottom part of the holder 43 are arranged a number of nozzles 46, generally directed downwards, and a liquid inlet 47. The reference numeral 48 designates the channel through which the water supply pipe runs to the inlet 47.

In computer rooms, for instance, it is of advantage to place necessary, often extensive cable bundles into the same channel 48. Upon activation of the spray head 45, in principle all in the same manner as in the embodiments of the FIGS. 1, 2 and 3, extinguishing liquid, preferably in the form of a water fog similar to the one produced by the nozzles 6, will be sprayed into the channel 48. Hereby is ensured that the fire does not spread through the channel 48 and is not capable of damaging cables placed in the channel either.

Figure 5:
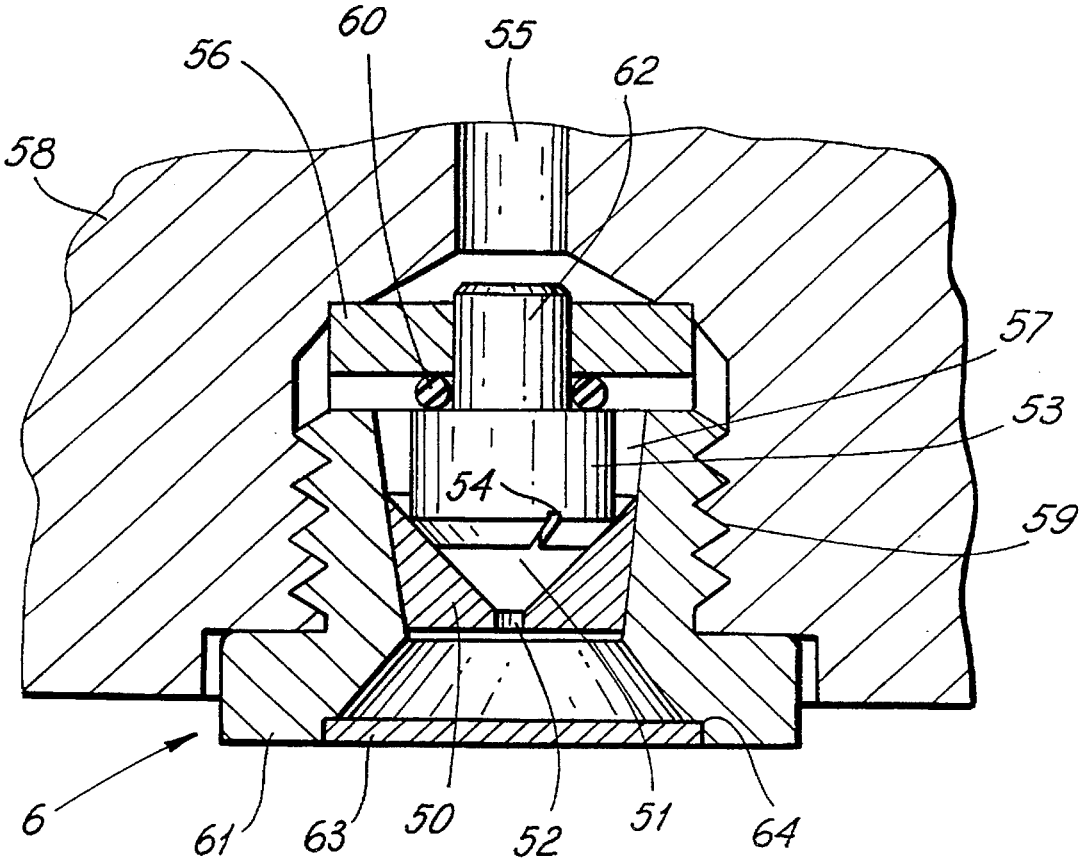
FIG. 5 shows an individual nozzle.

FIG. 5 shows an application of the invention, which preferably can be used in connection with individual objects liable to catch fire, e.g. friteuses for pommes frites.

In FIG. 5, the reference numeral 50 designates a nozzle intended to spread liquid in the form of fog-like drop formation. For that purpose the liquid should be in a strong whirling motion in the space 51 before the outlet aperture 52 of the nozzle 50, which can be brought about by means of a whirler 53 abutting the housing of the nozzle 50, said whirler being provided with at least one preferably oblique groove 54 for the liquid coming in from a supply channel 55 through a disk filter 56, preferably a sintered metal filter, to a ring space 57 located between the housing of the nozzle and the whirler 53, from which ring space 57 grooves 54 lead to the whirl space 51. The high pressure liquid flowing through the grooves 54 sets the whirler 53 in rapid rotation.

In the nozzle seat is formed an annular stop against which the sinter filter 56 bears acted upon by the nozzle housing, which is fastened in the spray head housing 58 by means of a thread 59 and presses the nozzle 50 against the whirler 53 and further via an elastic seal, preferably in the form of an O-ring 60, against the sinter filter 56 against said stop in the spray head housing 58.

A sealed abutment between the annular stop of the housing 58 and the filter 56 as well as between the annular stop of the housing 58 abutting the flange 61 of the nozzle body can be obtained thanks to the elastic seal member 60, which automatically compensates for tolerance deviations concerning said stops of the housing 58 in relation to the filter 58 and the flange 61 and, in addition, keeps the whole connection tight and enables a relatively loose, i.e. unsealed, mounting of the filter 56 on a pin 62 of the whirler 53.

The flange 61 of the nozzle body has a spread aperture of generally conical form but is preferably outmost provided with a cylindrical part, into which a shield 63 can be fitted, suitably in the form of a metal plate or a plastic plate.

The shield 63 can, before fitting into the spread aperture, have the general form of a calotte plate, which can be driven in e.g. by means of a hammer and a mandrel, so that the inner edge 64 of the plate 63 bites into the material of the nozzle holder 5 and ensures a tight fitting.

As long as the spray head is inactivated, the shield 63 sits reliably as a plug in front of the outlet aperture 53 of the nozzle 50 and prevents blocking of the same and damages in general. Upon activation of the spray head, the extinguishing liquid under high pressure presses the shield out.

I claim:

1. Fire-fighting equipment having a number of spray heads for spraying extinguishing liquid, at least a part of said spray heads being, in inactive state, covered by a shield, whereby said spray heads are of the type capable of operating with a high drive pressure, preferably producing concentrated fog sprays with strong penetration power, the respective shield being arranged, upon activation of the respective spray head, to be removed by the action of the extinguishing liquid, and at least one of said spray heads provided with a shield being movably mounted in a holder fastened in a floor in such a manner that said at least one spray head upon activation is lifed up by the extinguishing liquid thus removing the shield provided in front of said at least one spray head.

2. Fire-fighting equipment according to claim 1, whereby said at least one spray head is arranged to be lifted up to such an extent that the nozzles of said at least one spray head rise a little higher than the surface of the floor.

3. Fire-fighting equipment according to claim 1, wherein the respective spray head and the respective holder are arranged to cooperate like a hydraulic cylinder.

4. Fire-fighting equipment according to claim 1, wherein the holder has at least one nozzle for spraying liquid into a cable channel or the like located under the floor.

5. Fire-fighting equipment comprising:

a spray head (5) having a number of nozzles (6) for spraying extinguishing liquid in an active state;

a holder (3) for recessing the spray head below a top of the holder in an inactive state when the nozzles are not spraying the extinguishing liquid, whereby the holder can be recessed in a floor with the top at the floor;

shield means (8) on the top of the holder for covering at least a part of the spray head in the inactive state and removal by action of the extinguishing liquid in the active state; and moving means (13, 14) movably mounting the spray head for lifting up the spray head relative to the holder with the extinguishing liquid in the active state.

6. Fire-fighting equipment according to claim 5, wherein the lifting up lifts the spray head to such an extent that at least some of the nozzles rise higher than the top of the housing and, thereby, the floor when the top of the holder is thereat.

7. Fire-fighting equipment according to claim 5, wherein the moving means comprises arrangement of the spray head and the holder for cooperation like a hydraulic piston and cylinder.

8. Fire-fighting equipment according to claim 6, wherein the moving means comprises arrangement of the spray head and the holder for cooperation like a hydraulic piston and cylinder.

9. Fire-fighting equipment according to claim 5, and further comprising at least one nozzle in the holder for spraying the extinguishing liquid into a cable channel or the like located under the floor when the holder is recessed in the floor.

10. Fire-fighting equipment according to claim 6, and further comprising at least one nozzle in the holder for spraying the extinguishing liquid into a cable channel or the like located under the floor when the holder is recessed in the floor.

11. Fire-fighting equipment according to claim 7, and further comprising at least one nozzle in the holder for spraying the extinguishing liquid into a cable channel or the like located under the floor when the holder is recessed in the floor.

12. Fire-fighting equipment according to claim 8, and further comprising at least one nozzle in the holder for spraying the extinguishing liquid into a cable channel or the like located under the floor when the holder is recessed in the floor.

* * * * *